US006942446B2

(12) United States Patent
Penzar et al.

(10) Patent No.: US 6,942,446 B2
(45) Date of Patent: Sep. 13, 2005

(54) FEED PUMP

(75) Inventors: Zlatko Penzar, Frankfurt (DE); Hans-Dieter Wilhelm, Darmstadt (DE)

(73) Assignee: Siemens Aktiegesellschaft, Munich (DE)

( * ) Notice: Subject to any disclaimer, the term of this patent is extended or adjusted under 35 U.S.C. 154(b) by 0 days.

(21) Appl. No.: 10/450,264

(22) PCT Filed: Dec. 13, 2001

(86) PCT No.: PCT/DE01/04675

§ 371 (c)(1),
(2), (4) Date: Jun. 12, 2003

(87) PCT Pub. No.: WO02/48551

PCT Pub. Date: Jun. 20, 2002

(65) Prior Publication Data

US 2004/0028521 A1 Feb. 12, 2004

(30) Foreign Application Priority Data

Dec. 14, 2000 (DE) ..... 100 62 451

(51) Int. Cl.[7] ..... F01D 1/12; F04D 1/04

(52) U.S. Cl. ..... 415/55.1; 415/55.2; 415/55.3; 415/55.4; 415/101; 415/102

(58) Field of Search ..... 415/55.1, 55.2, 415/55.3, 55.4, 101, 102

(56) References Cited

U.S. PATENT DOCUMENTS

| | | | | | |
|---|---|---|---|---|---|
| 1,861,837 | A | * | 6/1932 | Burks | 415/55.1 |
| 1,960,659 | A | * | 5/1934 | Burks | 417/29 |
| 4,678,395 | A | | 7/1987 | Schweinfurter | |
| 5,702,229 | A | | 12/1997 | Moss et al. | |
| 6,100,618 | A | | 8/2000 | Schoeb et al. | |
| 6,152,688 | A | * | 11/2000 | Staab et al. | 415/55.5 |
| 6,224,323 | B1 | * | 5/2001 | Murase et al. | 415/55.1 |
| 6,280,157 | B1 | * | 8/2001 | Cooper | 417/423.7 |
| 6,425,734 | B2 | * | 7/2002 | Marx | 415/55.1 |
| 6,471,466 | B2 | * | 10/2002 | Marx et al. | 415/55.1 |
| 6,527,507 | B2 | * | 3/2003 | Rollwage et al. | 415/55.1 |

FOREIGN PATENT DOCUMENTS

| | | | | |
|---|---|---|---|---|
| DE | 19926587 A1 | * | 12/2000 | F04D/5/00 |
| JP | 61190191 A | * | 8/1986 | F04D/5/00 |

* cited by examiner

*Primary Examiner*—Theresa Trieu
(74) *Attorney, Agent, or Firm*—Morrison & Foerster LLP

(57) ABSTRACT

The invention relates to a feed pump (2) that is configured as a side-channel pump with a plurality of identically designed feed chambers (6, 7) with outlet channels (22, 23) that are disposed opposite one another, thereby eliminating the radial forces acting upon the impeller (4) of the feed pump (2). The feed pump (2) according to the invention is especially wear-free and has a very high degree of efficiency.

6 Claims, 2 Drawing Sheets

FEED PUMP

CLAIM FOR PRIORITY

This application claims priority to International Application No. PCT/DE01/04675, which was published in the German language on Jun. 20, 2002, which claims the benefit of priority to German Application No. 10062451.0 which was filed in the German language on Dec. 14, 2000.

TECHNICAL FIELD OF THE INVENTION

The invention relates to a feed pump with a driven impeller which rotates in a pump casing and which has in its end faces at least one ring of guide vanes delimiting vane chambers, and with at least one part-annular channel which is arranged in the region of the guide vanes in the pump casing and which forms, with the vane chambers, a feed chamber from an inlet duct to an outlet duct.

BACKGROUND OF THE INVENTION

Such feed pumps are often used, for example in present-day motor vehicles, for feeding fuel or windshield cleaning fluid and are known from practice. The impeller of the feed pump is fastened on a shaft of an electric motor. The feed pump has as an axial bearing, in a radially inner region of the impeller, as seen from the vane chambers, interconnected pockets for collecting the fluid to be fed by the pump. These pockets form, with the fluid, an axial plain bearing.

One disadvantage of the known feed pump is that the impeller and consequently the shaft driving the impeller are subjected to very high load in the radial direction, since the pressure within the feed chamber is substantially higher in the region of the outlet duct than in the -region of the inlet duct. This leads to very high friction in bearings of the impeller. Moreover, the friction reduces the efficiency of the feed pump.

SUMMARY OF THE INVENTION

It is an object of the invention to configure a feed pump of the type initially mentioned, in such a way that it has as high efficiency as possible.

According to an aspect of the invention, a plurality of feed chambers, of which the outlet ducts and inlet ducts are arranged in each case symmetrically about the axis of rotation of the impeller, is provided.

By virtue of this configuration, the forces transmitted to the impeller by the fluid flowing in the feed chambers have, in the radial direction, directions of force which are opposite to one another. The forces consequently cancel one another, so that bearing forces of the shaft driving the impeller can be kept particularly low. The feed pump according to this aspect of the invention therefore has particularly high efficiency. A further advantage of this configuration of the feed pump according to this aspect of the invention is that it has very low wear and therefore has a particularly long useful life.

According to this aspect of the invention, the feed pump may have a multiplicity of feed chambers if the feed chambers in each case extend over a fraction of their circle diameter.

The feed chambers of the feed pump according to this aspect of the invention extend over virtually their entire circle diameter when the feed chambers are arranged on opposite end faces of the impeller. As a result, the feed pump has particularly high efficiency.

According to another aspect of the invention, axial forces can be distributed uniformly over one side of the impeller when vane chambers arranged on the two end faces of the impeller overlap and when the inlet ducts of the feed chambers are arranged on one end face of the impeller and the outlet ducts on the other end face of the impeller. The axial forces acting on the impeller can thereby be supported in a simple way. Furthermore, as a result of this configuration, the feed pump according to the invention has the flow passing through it axially and can therefore be arranged in a particularly space-saving way, for example, in a feed unit for fuel in a motor vehicle.

According to another advantageous development of the invention, a mounting of the impeller is configured in a particularly simple way in structural terms when a radial bearing is arranged between the impeller and an electric motor driving the impeller and an axial bearing is arranged on that side of the impeller which is located opposite the radial bearing.

According to another aspect of the invention, the axial bearing is constructed in a particularly simple way and can therefore be manufactured particularly cost-effectively when the axial bearing has a ball provided for supporting a shaft driving the impeller.

The feed pump according to the invention has particularly low flow losses and consequently very high efficiency when the outlet ducts and/or the inlet ducts are arranged so as to point in the radial direction toward the feed chambers.

DETAILED DESCRIPTION OF THE INVENTION

Figure 1:
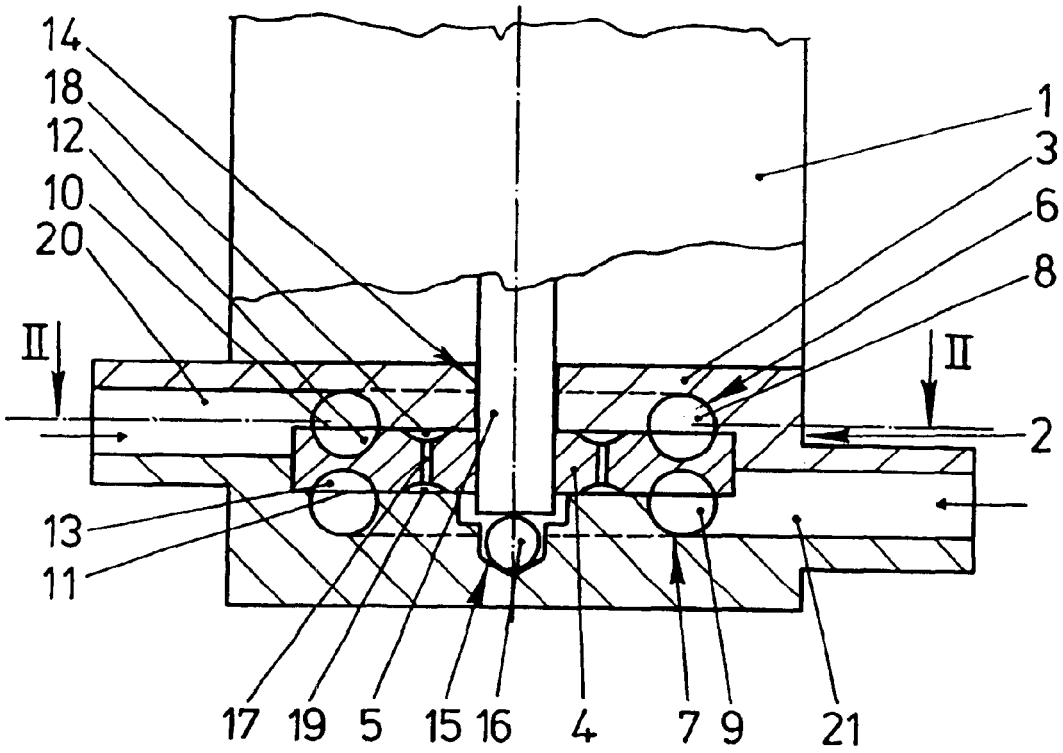
FIG. 1 shows a feed pump according to the invention in longitudinal section.

FIG. 1 shows a feed pump 2 driven by an electric motor 1 and having an impeller 4 rotating in a pump casing 3. The feed pump 2 is designed as a side-channel pump and can be used, for example, for the feed of fuel or windshield washing fluid in a motor vehicle. The impeller 4 is fastened on a shaft 5 of the electric motor 1. The feed pump 2 has two feed chambers 6, 7 separate from one another. The feed chambers 6, 7 have in each case a part-annular channel 8, 9 arranged in the pump casing 3 and vane chambers 12, 13 delimited by guide vanes 10, 11 of the impeller 4. The shaft 5 has, near the electric motor 1, a radial bearing 14 and, below the impeller 4, an axial bearing 15 with a ball 16 arranged in the pump casing 3. The ball 16, like the shaft 5, is hardened. Pockets 18, 19 connected to one another via ducts 17 are worked in the end faces of the impeller 4. The pockets 18, 19 are filled by the leakage of the fluid to be fed and, with the opposite wall of the pump casing 3, form axial plain bearings.

Figure 2:
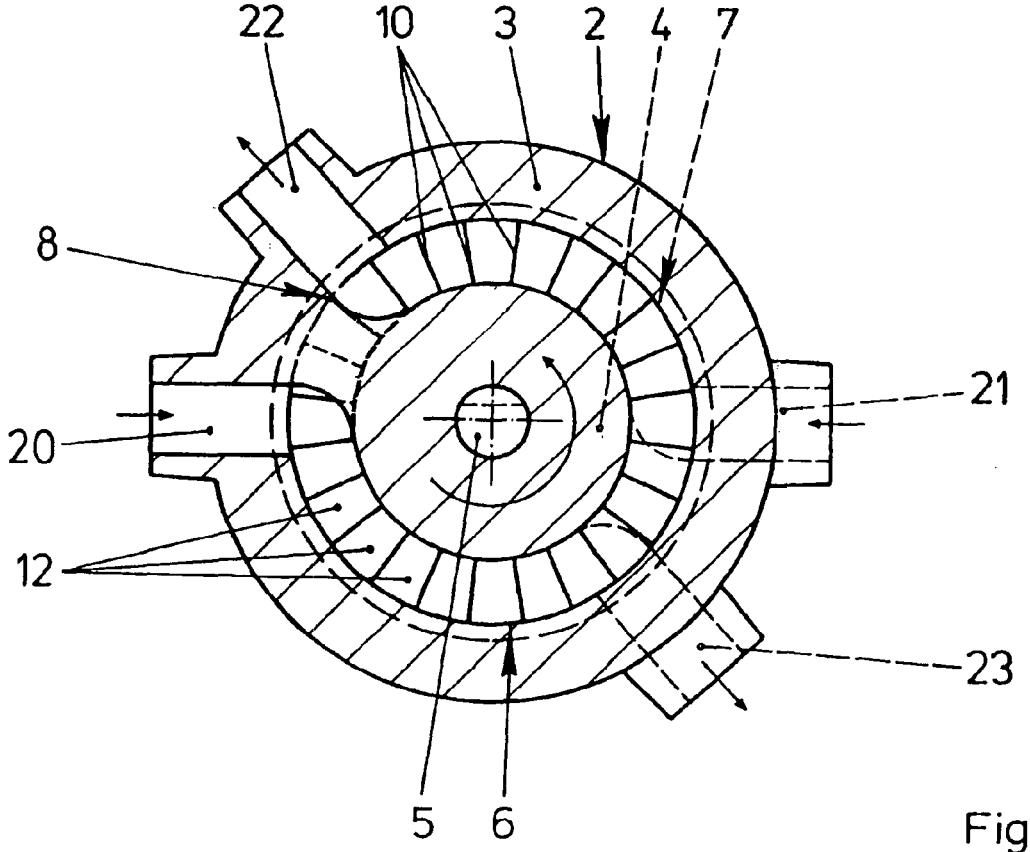
FIG. 2 shows the feed pump from FIG. 1 in sectional illustration along a line II—II.

As FIG. 2 shows in a cross section through the feed pump 2 from FIG. 1 along the line II-II, the feed chambers 6, 7 have in each case an inlet duct 20, 21 and an outlet duct 22, 23.

The inlet ducts 20, 21 issue in each case into the start of the part-annular channels 8, 9. The outlet ducts 22, 23 are arranged at the ends of the part-annular channels 8, 9 in the direction of flow of the fluid to be fed. For illustration, the direction of rotation of the impeller 4 and the directions of flow in the inlet ducts 20, 21 and the outlet ducts 22, 23 are identified by arrows. During a rotation of the impeller 4, the guide vanes 10, 11 generate circulating flows in the feed chambers 6, 7 and feed the fluid from the inlet ducts 20, 21 to the outlet ducts 22, 23. The inlet ducts 20, 21 and the outlet ducts 22, 23 are in each case arranged opposite one another. Since a higher pressure prevails in the feed chambers 6, 7 near the outlet ducts 22, 23 than at the inlet ducts 20, 21, the radial forces acting on the impeller 4 cancel one another as a result of this configuration.

Furthermore, FIGS. 1 and 2 show that the inlet ducts 20, 21 and the outlet ducts 22, 23 are arranged so as to point in the radial direction toward the feed chambers 6, 7.

Figure 3:
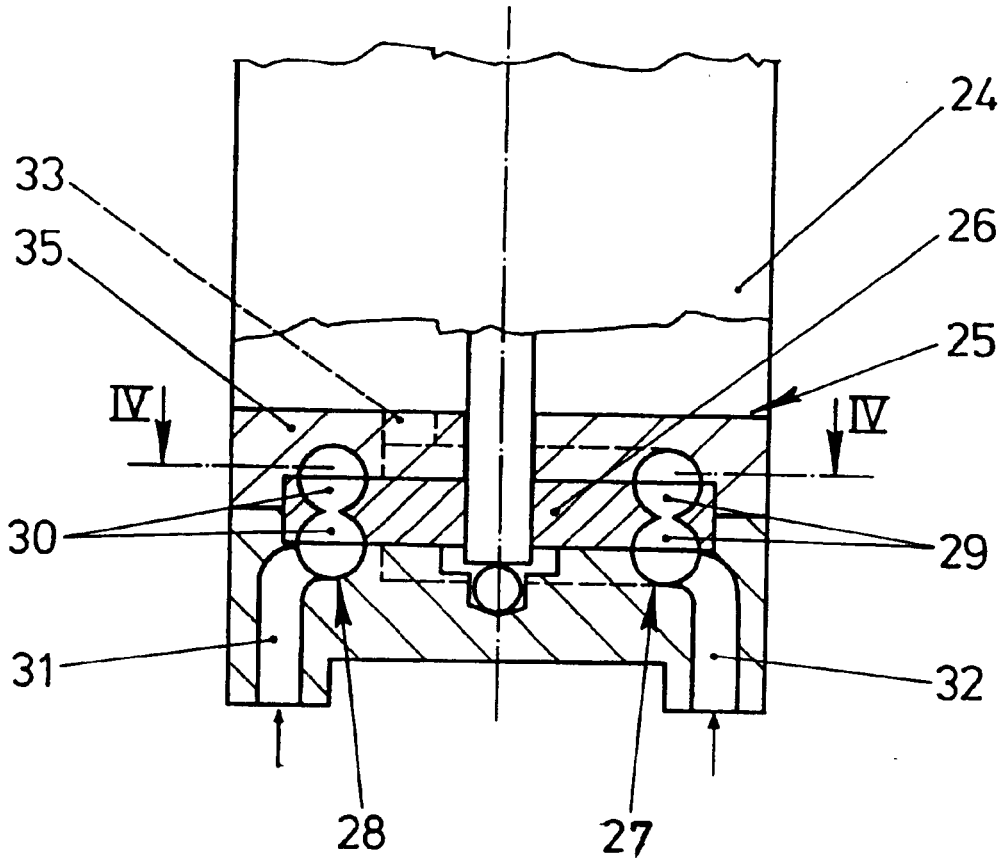
FIG. 3 shows a further embodiment of the feed pump according to the invention in longitudinal section.
Figure 4:
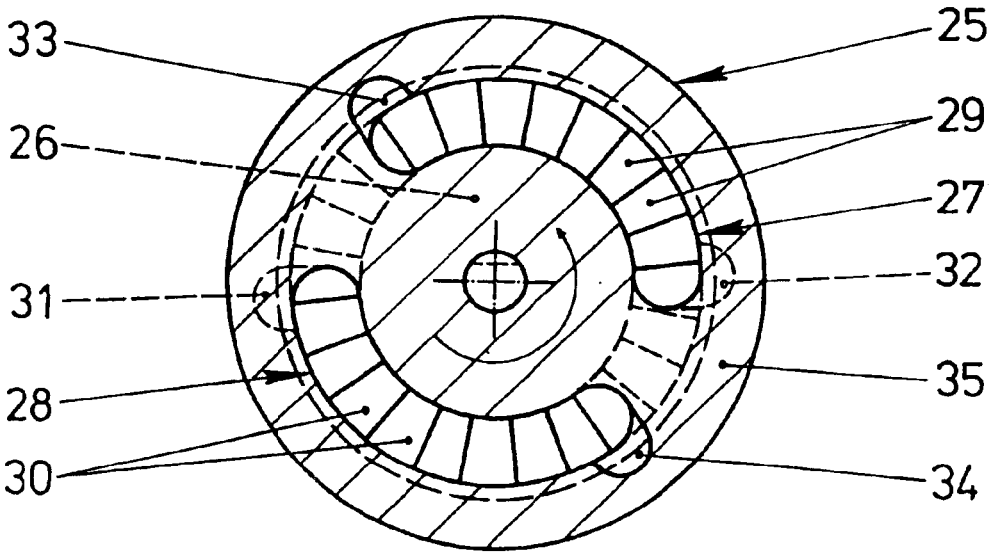
FIG. 4 shows the feed pump from FIG. 3 in sectional illustration along a line IV—IV.

FIG. 3 shows a feed pump 25 driven by an electric motor 24 and having feed chambers 27, 28 passing through an impeller 26. For this purpose, vane chambers 29, 30 arranged in the impeller 26 and located opposite one another are connected to one another. On its side facing away from the electric motor 24, the feed pump 25 has two inlet ducts 31, 32 issuing from radially outside into a feed chamber 27, 28 in each case. FIG. 4 shows, in a cross section through the feed pump 25 from FIG. 3 along the line IV—IV, that the feed chambers 27, 28 extend over a fraction of their circle diameter. The feed chambers 27, 28 have in each case an outlet duct 33, 34 led slightly radially outward. The outlet ducts 33, 34 and consequently also the inlet ducts 31, 32 are arranged opposite one another, so that radial forces acting on the impeller 26 cancel one another. FIG. 3 shows, for example at one of the outlet ducts 33, that the outlet ducts 33, 34 pass through a pump casing 35 in the direction of the electric motor 24. This feed pump 25 is designed as a side-channel pump. The feed pump 25 may, of course, also be configured as a peripheral pump with vane chambers arranged in the outer circumference.

What is claimed is:

1. A feed pump with a driven impeller which rotates in a pump casing and which has in its end faces at least one ring of guide vanes delimiting vane chambers, and with at least one part-annular channel which is arranged in the region of the guide vanes in the pump casing and which forms, with the vane chambers, a feed chamber from an inlet duct to an outlet duct, comprising:

a plurality of feed chambers, of which the outlet ducts and inlet ducts are each arranged symmetrically about an axis of rotation of the impeller, wherein vane chambers arranged on the two end faces of the impeller overlap, and the inlet ducts of the feed chambers are arranged on one end face of the impeller and the outlet ducts on the other end face of the impeller.

2. The feed pump as claimed in claim 1, wherein the feed chambers each extend over a fraction of their circle diameter.

3. The feed pump as claimed in claim 1, wherein the feed chambers are arranged on opposite end faces of the impeller.

4. The feed pump as claimed in claim 1, wherein a radial bearing is arranged between the impeller and an electric motor driving the impeller and an axial bearing is arranged on a side of the impeller which is located opposite the radial bearing.

5. The feed pump as claimed in claim 1, wherein the axial bearing has a ball provided for supporting a shaft driving the impeller.

6. The feed pump as claimed in claim 1, wherein the outlet ducts and/or the inlet ducts are arranged so as to point in a radial direction toward the feed chambers.

* * * * *